United States Patent [19]

Coffman

[11] Patent Number: 4,964,228

[45] Date of Patent: Oct. 23, 1990

[54] DRYER DOOR MECHANISM

[75] Inventor: Randall R. Coffman, Palatine, Ill.

[73] Assignee: Norman Dryer Company, Inc., Crystal Lake, Ill.

[21] Appl. No.: 334,470

[22] Filed: Apr. 7, 1989

[51] Int. Cl.[5] ..... F26B 25/00

[52] U.S. Cl. ..... 34/242; 34/133; 49/208; 49/360

[58] Field of Search ..... 34/242, 133; 49/213, 49/488, 145, 260, 256, 242, 151, 360, 226, 208

[56] References Cited

U.S. PATENT DOCUMENTS

| | | | |
|---|---|---|---|
| 400,562 | 4/1889 | Goelet | 49/213 |
| 2,254,900 | 9/1941 | Lessmann | 34/242 |
| 3,231,259 | 1/1966 | Bobrowski et al. | 49/360 |
| 4,067,144 | 1/1978 | Ogishi | 49/360 |
| 4,452,014 | 6/1984 | Markus | 49/360 |

*Primary Examiner*—Albert J. Makay
*Assistant Examiner*—John Sollecito
*Attorney, Agent, or Firm*—Lee, Mann, Smith, McWilliams & Sweeney

[57] ABSTRACT

A dryer door mechanism for the opening, closing and sealing of an opening to a dryer enclosure. The door mechanism has a movable door in rolling engagement with a pair of tracks affixed to a door frame. The tracks of the door frame are angularly disposed from both the plane of the enclosure opening and the plane of the movable door. The movable door, while rolling along its track, simultaneously moves perpendicular and parallel to the plane of the enclosure opening. When moved to the closed position, the movable door becomes wedged against the enclosure opening thereby providing a force perpendicular to the opening of the enclosure for creating an airtight seal.

16 Claims, 3 Drawing Sheets

3.
4.
24
18
30
20
22
28
38
54
52
48
50
34
32
66
68
64
70
78
80
60
26
56
72
74
76
58
36

11
14
16
18
20
22
24
26
28
32
34
36
40
42
44
46
54
60
62
70
72
74
76

DRYER DOOR MECHANISM

BACKGROUND OF THE INVENTION

This invention relates to a door mechanism for equipment such as commercial laundry dryers, and particularly to a door mechanism wherein a movable door becomes wedged into a tight seal with the dryer when the door is closed.

A typical commerical dryer includes a tumbler which rotates about a central axis within a tumbler enclosure. The enclosure is pivoted about either a top or bottom pivot in order to expel dried goods. The enclosure has an opening through which wet goods are inserted and dried goods are removed. Some type of door is provided for closing the enclosure opening.

One type of typical dryer door mechanism utilizes one or more pivoting connections between the door and the dryer enclosure. To open such a door, the door must be swung out and away from the enclosure, thereby requiring that the space adjacent to the door be open and unobstructed. These pivoting types of doors move through a circular arc and are held closed by a force that is perpendicular to the plane of the door and the enclosure opening. U.S. Pat. Nos. 2,852,236, 2,906,035, 3,064,361 and 2,768,451 disclose doors with such pivoting means.

Another type of dryer door mechanism utilizes a door that slides, in a direction parallel to the plane of the enclosure opening. When these sliding doors are closed, the leading edge of the door exerts a force parallel to the plane of the door. U.S. Pat. Nos. 4,509,275 and 4,015,930 disclose such sliding doors. However, such a door is not forced perpendicular to the plane of the door against the enclosure. Without such a perpendicular force, the sliding door is not effectively sealed at the sides and trailing edge of the door.

The pivoting doors and the sliding doors have previously been directly attached to the enclosure. In those instances where the enclosure is pivotable, the door also pivots with the enclosure. This also requires extra unobstructed open space for the door to pivot through.

SUMMARY OF THE INVENTION

The present invention provides a movable door that wedges itself against the opening of an enclosure. Through this wedging action, the movable door exerts a force perpendicular to the plane of the door, and against the enclosure, thereby creating a tight seal around the enclosure opening and preventing the heated drying air within the enclosure from escaping. The movable door translates between its open and closed positions in a path between two guideways which are angularly disposed relative to the enclosure opening. The movable door is opened by rolling it in a substantially upward direction to a position out of the working area, thus eliminating the need for unobstructed space in front of the dryer. The door mechanism does not require direct attachment to the enclosure, thus allowing a pivoting enclosure to pivot while the door mechanism remains pivotally stationary. The present invention provides a door mechanism which consists of a movable door segment and a stationary door segment, thereby creating an access opening to the enclosure that is smaller than the enclosure opening itself.

The invention includes a door frame which is rectangular in shape and is oriented in a generally vertical position, although non-vertical positions may also be used. The door frame may be completely detached from the tumbler enclosure by fastening the door frame directly to the ground, or it may be directly attached to the enclosure. The door frame may also be attached to any suitable external support for the pivoting enclosure. In use with pivoting enclosures it is particularly advantageous to have the door frame attached either to the ground or to the stationary external support, allowing the door frame to remain stationary while the enclosure is free to rotate.

A movable door is provided within the door frame. The movable door translates between its open and closed positions along two guideways, each guideway being between the movable door and a respective interior side of the door frame. The guideways are parallel to one another, and are angularly disposed from the plane of the enclosure opening, being in a generally narrow V-shaped relationship to the enclosure opening when viewed from the side. The guideways themselves may take on a variety of configurations.

A preferred guideway comprises an inverted V-shaped structural angle track and track follower means having a pair of rollers. A track is mounted on each of the two interior sides of the door frame. The track follower means are affixed to the movable door in such positions as to place the plane of the movable door parallel to the plane of the enclosure opening so that the movable door may fully abut the rim of the enclosure opening. The track follower means engage the tracks between the rollers of the track follower means, thereby allowing the movable door to roll along the tracks.

Extensible fluid cylinders are provided for shifting the movable door between its open and closed positions or to any position in between. The fluid cylinders may be either hydraulic or pneumatic. The fluid cylinders are attached between the movable door and the door frame, the cylinders being located on respective sides of the door frame. The fluid cylinders are actuated to extend or retract their rams to shift the movable door between its open or closed orientations, thereby controlling access to the enclosure opening. Upper and lower limit switches are provided to indicate when the door is in the fully open or fully closed positions. When the door reaches its fully closed or fully open position, a limit switch actuator attached to the door actuates the proper limit switch which generates a signal to deactivate the fluid cylinders.

The movable door, while being translated between its closed and open positions, moves in both a horizontal and vertical direction in relationship to the plane of the enclosure opening, with the movement in the vertical direction being substantially greater in proportion to the movement in the horizontal direction. Thus, when the movable door is closed, it will become wedged against the enclosure opening, with a force normal to the enclosure opening, creating an airtight seal. A flexible seal material is provided between the rim of the enclosure opening and the movable door to facilitate an airtight seal.

When moved to its open position, the movable door is positioned away from the immediate area of the enclosure opening without interfering with any adjacent equipment such as conveyor belts that may be located in front of the dryer. Such equipment may thus be permanently positioned closely to the enclosure opening without the need of allowing clearance for a door to swing open.

A stationary lower door, in addition to the movable door, is affixed to the door frame. The door frame is positioned so that a surface of the stationary door will tightly abut against a portion of the enclosure opening, leaving the movable door to seal the remaining portoin of the enclosure opening. The movable door is affixed to the door frame so that when it is in the closed position, one edge of the movable door will come into tight abutting contact with an edge of the stationary door, thereby creating a seal between the two doors. A seal material may be placed between the abutting edges of the two doors to improve the seal between them.

BRIEF DESCRIPTION OF THE DRAWINGS

The invention is described in greater detail in the following detailed description of an example embodying the best mode of the invention, taken in conjuction with the drawings, in which.

DESCRIPTION OF AN EXAMPLE EMBODYING THE BEST MODE OF THE INVENTION

Figure 1A:
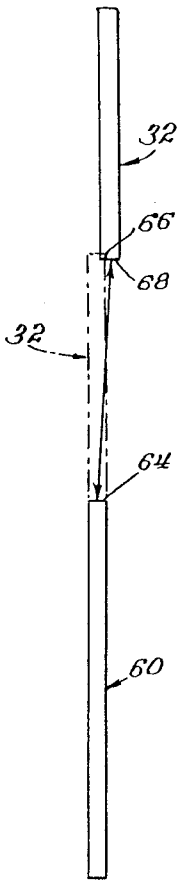
FIG. 1A is a schematic side elevational view of the doors illustrating the upper movable door in the open position and in phantom when closed.
Figure 1:
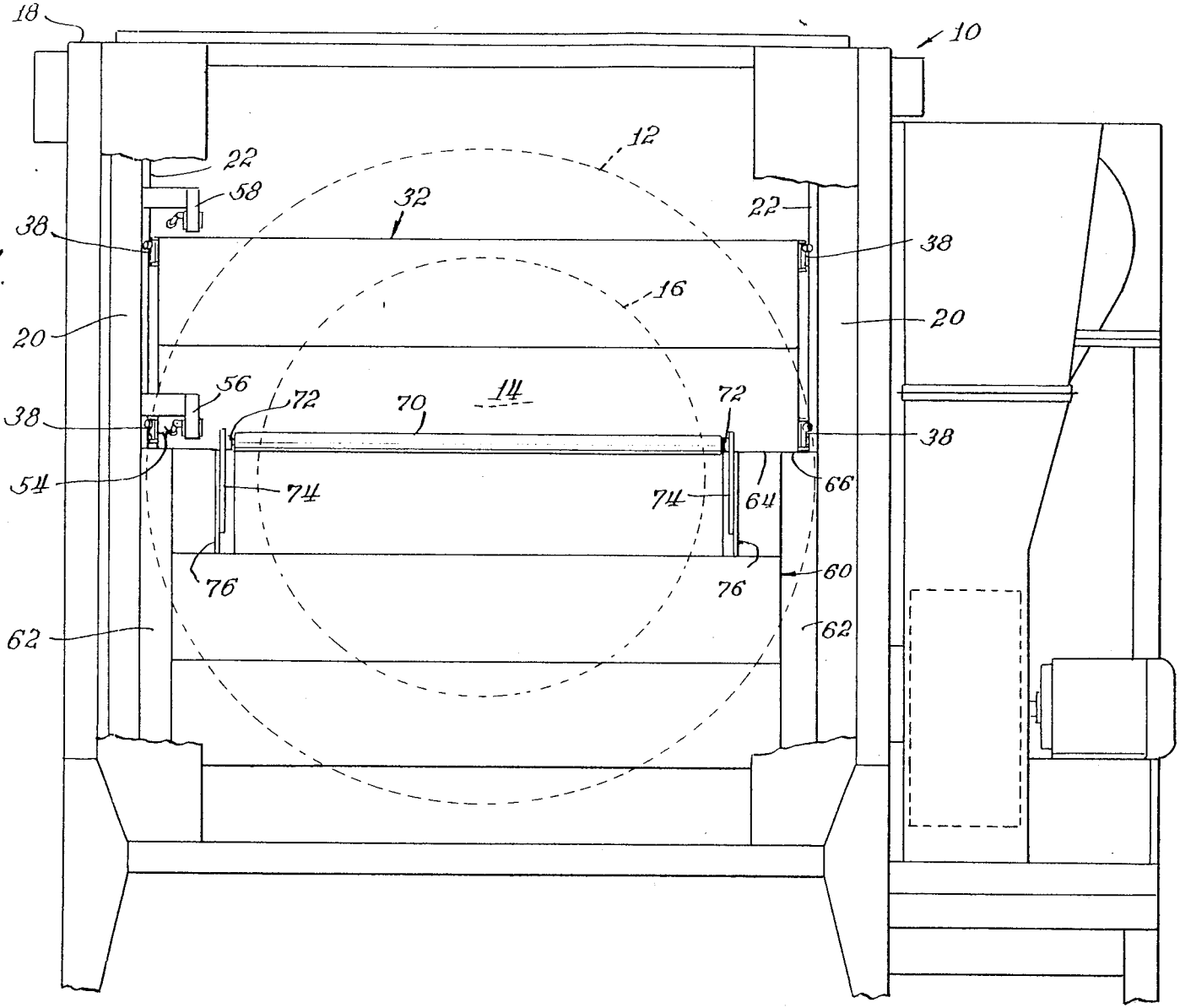
FIG. 1 is a front elevational view of the door mechanism according to the invention showing an upper movable door and a lower stationary door.
Figures 2, 3, 4, 5:
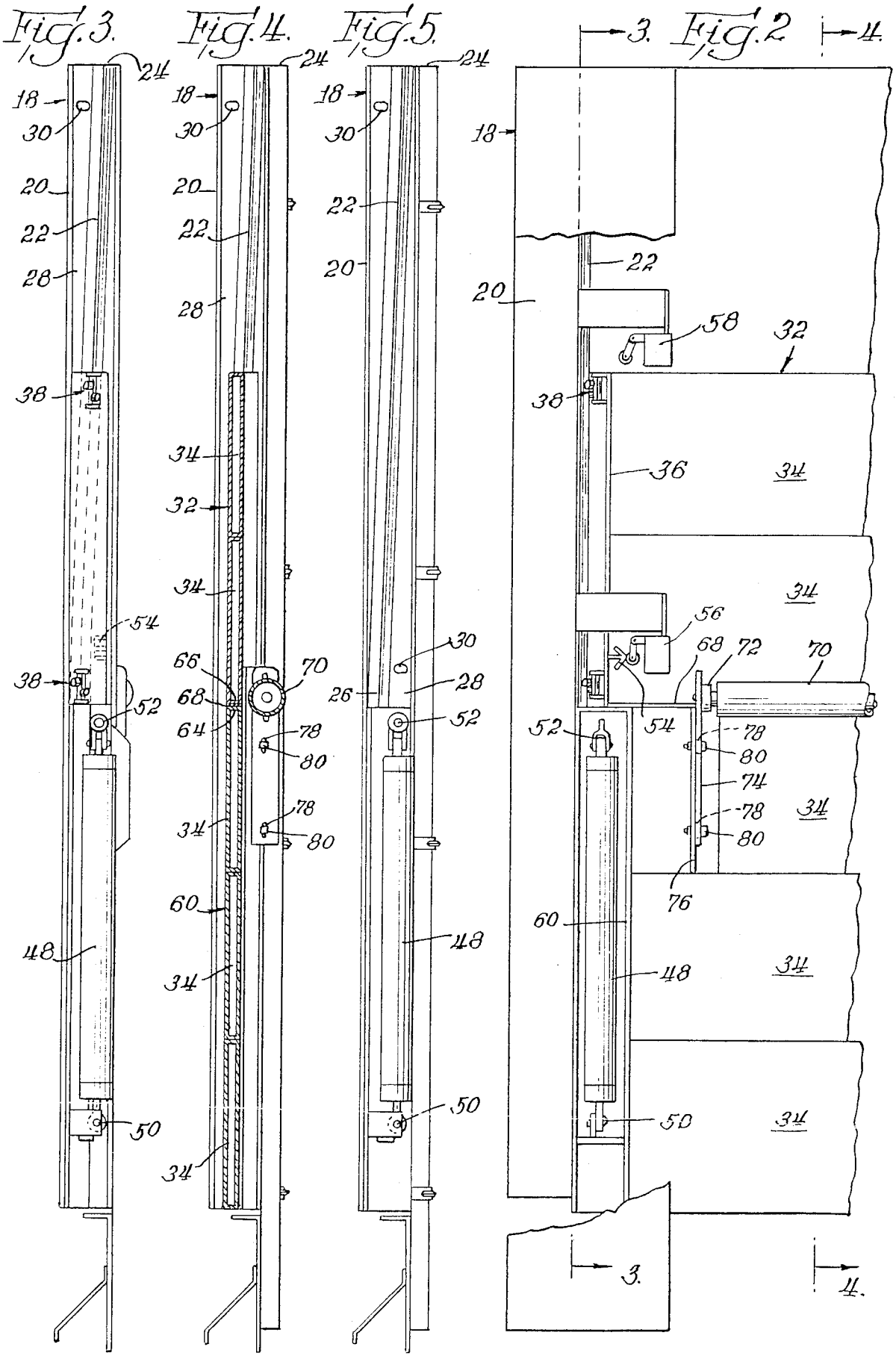
FIG. 2 is an enlarged partial elevational view of the left side of the door mechanism of FIG. 1.
FIG. 3 is a cross-sectional view of the door mechanism taken along lines 3—3 of FIG. 2.
FIG. 4 is a cross-sectional view of the door mechanism taken along lines 4—4 of FIG. 2.
FIG. 5 is an enlarged side elevational view taken near the door frame on the right side of FIG. 1.
Figures 6, 7, 8:
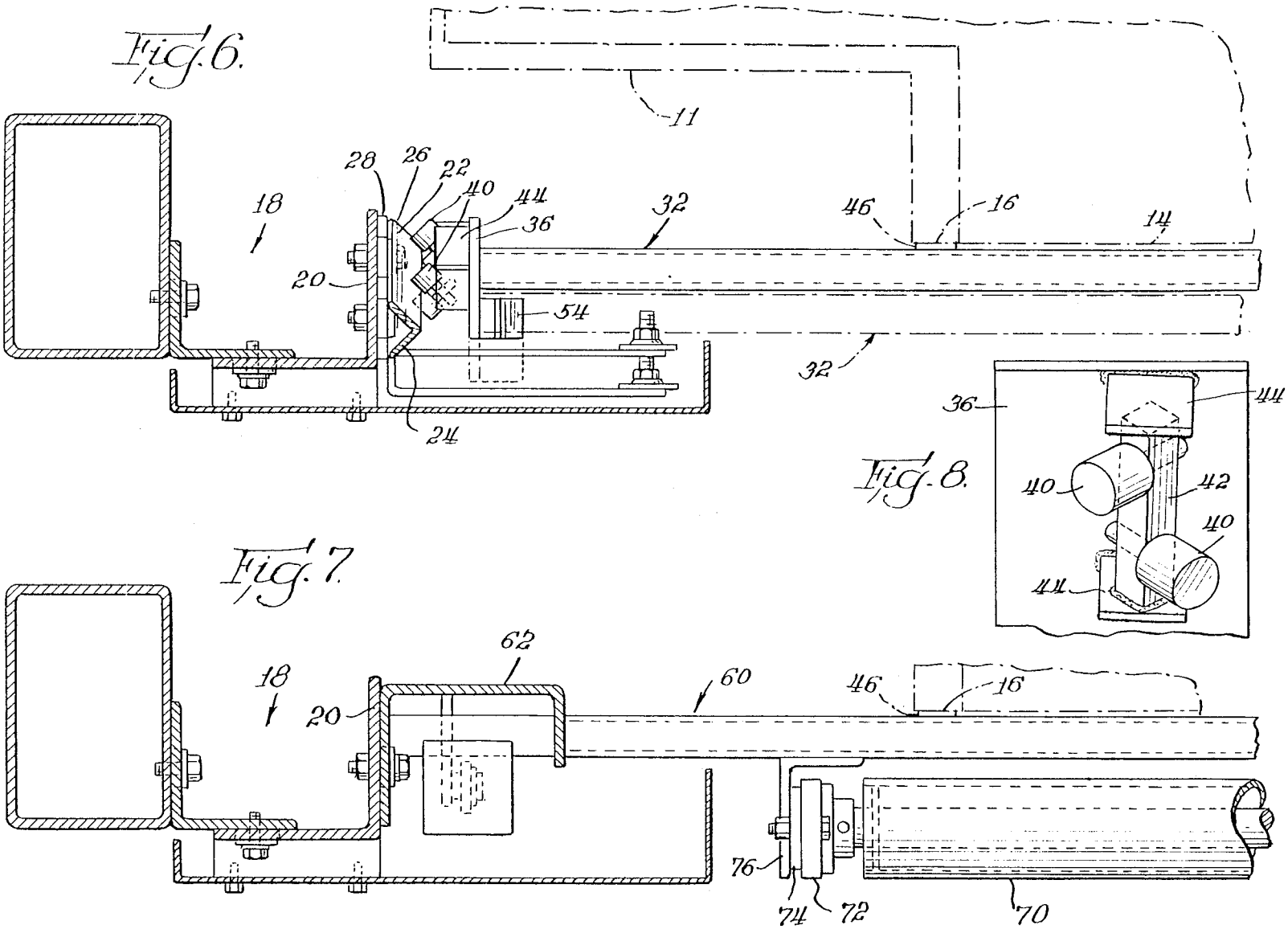
FIG. 6 is an enlarged horizontal cross section of the door mechanism taken from the top of the movable door.
FIG. 7 is an enlarged horizontal cross section of the door mechanism taken where the movable and stationary doors meet.
FIG. 8 is a further enlarged perspective view of one of the track follower means.

The door mechanism 10 is shown in FIG. 1 as being used in conjunction with an enclosure 12 for a tumbler (not illustrated) of a dryer. Such a tumbler may be similar to the one shown in U.S. Pat. No. 4,509,275. The enclosure 12 has an enclosure opening 14, the edge of which has a rim 16 which surrounds the enclosure opening 14. The door mechanism 10 includes a door frame 18 which is rectangular and is substantially vertical.

A track 22 comprising an equal legged inverted V-shaped structural angle is affixed to an adjustable plate 28. The adjustable plate 28 is fastened to the interior portion of each vertical side 20 of the door frame 18 through slotted holes 30. The tracks 22 are affixed to the adjustable plate 28 in such a way that they are parallel to one another with the longitudinal axis of the tracks 22 being angularly disposed from the plane of the enclosure opening 14. The tracks 22 are affixed to the adjustable plate 28 in an oblique fashion with the top ends 24 of the tracks 22 being located near the upper corner of the adustable plate 28 which is the furthest from the enclosure opening 14, and the lower ends 26 of tracks 22 being located near the lower corner of adjustable plate 28 which is the nearest to the enclosure opening 14.

A movable door 32 is mounted on the tracks 22. The door 32 is rectangular in shape and is composed of two door segments 34 one being situated above the other with an end plate 36 being affixed along both sides of door segments 34. The movable door 32 includes four track followers 38, one being located at the upper and lower extremity of each end plate 36. Each track follower 38 comprises two rollers 40 located at approximately a 90° angle from each other which are attached to a roller bar 42. The roller bar 42 is secured between brackets 44 which in turn are affixed to an end plate 36 of the movable door 32.

Each track followers 38 engages the track 22 between its two rollers 40, thereby allowing the door to roll along the track 22 without becoming disengaged therefrom. The two upper track followers 38 are affixed to the end plate 36 in such a position that they are spaced further from the plane of the enclosure opening 14, when measured in a perpendicular direction, than are the lower track followers 38. The differing placements of the upper and lower track followers 38 relative to the plane of the enclosure opening 14 is required so that the movable door 32 will lie in a plane parallel to the plane of the enclosure opening 14, thereby allowing the movable door 32 to come into full abutting contact with the rim 16 of the enclosure opening 14.

An extensible fluid cylinder 48 is provided at each vertical side 20 of the door frame 18. The extensible fluid cylinders 48 are pivotably attached at their lower ends 50 to the door frame 18 and at their upper ends 52 to the movable door 32. When the rams of the extensible fluid cylinders 48 are extended, the movable door 32 is raised to the position shown in FIG. 1A, permitting access to the enclosure opening 14. When the rams of the extensible fluid cylinders 48 are retracted, the movable door 32 is lowered into a wedging engagement with the rim 16 of the enclosure opening 14. A flexible seal 46 is provided between the movable door 32 and the rim 16 of the enclosure opening 14 to facilitate an airtight seal.

A limit switch actuator 54 is affixed to an end plate 36 of the movable door 32. A lower limit switch 56 is affixed to the door frame 18 in such a position that it will be actuated by the limit switch actuator 54 when the movable door 32 is in the fully closed position. An upper limit switch 58 is affixed to the door frame 18 in such a position that it will become actuated by the limit switch actuator 54 when the movable door 32 is in the fully open position. A signal from either the upper or lower limit switches 58 or 56 will signal the extensible fluid cylinders 48 to deactivte the extension or retraction of their rams.

A stationary door 60, composed of three door segments, one being situated above the other, is affixed to a channel 62 which in turn is affixed to the door frame 18. The stationary door 60 is positioned so that the upper edge 64 of the stationary door 60 will be abutted by the lower edge 66 of the movable door 32 when the movable door 32 is in its fully closed position. A flexible seal 68 is provided between the upper edge 64 of the stationary door 60 and the lower edge 66 of the movable door 32 to facilitate an airtight seal. The stationary door 60 is also positioned so that it will be tightly abutted by the rim 16 of the enclosure opening 14, thereby compressing flexible seal 46 and creating an airtight seal.

A loading roller 70 is attached to the door 60 to facilitate loading through the access opening provided by the movable door 32. The roller 70 is journalled in a bearing 72 at opposite ends of the loading roller 70 to permit the roller 70 to freely rotate about its longitudinal axis. Each bearing 72 is affixed to a loading roller support plate 74. The roller support plates 74 are connected to brackets 76 which are affixed to the stationary door 60. The brackets 76 and the roller support plate 74 are connected through slotted holes 78 by fasteners 80 to allow the position of the loading roller 70 to be adjusted.

To load the dryer enclosure 12, the extensible fluid cylinders 48 are activated, extending their rams to open the movable door 32. The extensible fluid cylinders 48 translate the movable door 32 along tracks 22 to a position that is out of and above the working area. When the movable door 32 is fully opened, the limit switch actuator 54 will actuate the upper limit switch 58 which will deactivate the extensible fluid cylinders 48.

When the loading of the dryer enclosure 12 is completed, the extensible fluid cylinders are activated, retracting their rams to close the movable door 32. The extensible fluid cylinders 48 translate the movable door 32 along tracks 22 in a path that is angularly disposed from the enclosure opening 14. As the movable door 32 reaches its closed position, it becomes wedged against the enclosure opening 14, creating an airtight seal. When the movable door 32 reaches its closed position, the limit switch actuator 54 will actuate the lower limit switch 56 which will deactivate the extensible fluid cylinders 48. The enclosure 12 may be unloaded by pivoting away from the movable door 32 and the stationary door 60 while the doors 32 and 60 remain stationary.

Various changes may be made to the invention without departing from the spirit thereof or scope of the following claims.

What is claimed is:

1. A dryer door mechanism for the opening, closing and sealing of a generally planar opening to a dryer enclosure comprising:

a door frame having two generally parallel sides;

a movable door mounted within said door frame having a generally planar interior surface and two generally parallel sides, said interior surface and two generally parallel sides, said interior surface being formed to sealingly abut said enclosure opening; and a pair of guideways located at opposite sides of said movable door, each guideway including a track means having an upper end and a lower end connected to a side of said door frame and track follower means connected to said movable door for translatably attaching said movable door to said track means, said track means being parallel to one another and angularly disposed with respect to the plane of said enclosure opening with said upper ends being spaced further from said enclosure opening than said lower ends, said movable door being translatable along said track means simultaneously parallel and perpendicular to the plane of said enclosure opening between closed and open positions, said track means wedging said movable door against said dryer enclosure as said movable door translates to said closed position such that said interior surface of said door is wedged with a force normal to said enclosure opening into sealing abutment with said enclosure opening.

2. The mechanism of claim 1 wherein four track follower means are affixed to said movable door, two track followers being affixed to each respective side of said movable door.

3. The mechanism of claim 1 wherein the track follower means are provided with a pair of rollers, each roller being in rolling engagement with said track means.

4. The mechanism of claim 1 including door actuator means attached to said movable door for translating said movable door.

5. The mechanism of claim 4 wherein said door actuator means allow said movable door to be translated to any position between and including fully closed and fully open.

6. The mechanism of claim 4 wherein said door actuator means comprises a pair of fluid cylinders, each fluid cylinder being connected to a respective side of said movable door and said door frame.

7. The mechanism of claim 6 wherein said door actuator means includes a limit switch actuator affixed to said movable door, and stationary upper and lower limit switches affixed to said door frame and in communication with said fluid cylinders.

8. The mechanism of claim 1 incliding a seal affixed to and surrounding the opening of the enclosure, said seal being compressed between said enclosure and the interior surface of said movable door when said movable door is in the closed position.

9. A dryer door mechanism for the opening, closing and sealing of a generally planar opening to a dryer enclosure comprising:

a door frame having two generally parallel sides;

a movable door mounted within said door frame having a generally planar interior surface and two generally parallel sides, said interior surface being formed to sealingly abut said enclosure opening and to cover a portion of said enclosure opening;

a stationary door affixed to said door frame, said stationary door being in abutting contact with and covering the remainder of said enclosure opening; and a pair of guideways located at opposite sides of said movable door, each guideway including a track means having an upper end and a lower end connected to a side of said door frame and track follower means connected to said movable door for translatably attaching said movable door to said track means, said track means being parallel to one another and angularly disposed with respect to the plane of said enclosure opening with said upper ends being spaced further from said enclosure opening than said lower ends, said movable door being translatable along said track means simultaneously parallel and perpendicular to the plane of said enclosure opening between closed and open positions, said track means wedging said movable door against said dryer enclosure as said movable door translates to said closed position such that said interior surface of said door is wedged with a force normal to said enclosure opening into sealing abutment with said enclosure opening.

10. The mechanism of claim 9 wherein four track follower means are affixed to said movable door, two track followers being affixed to each respective side of said movable door.

11. The mechanism of claim 9 wherein the track follower means are provided with a pair of rollers, each roller being in rolling engagement with said track means.

12. The mechanism of claim 9 including door actuator means attached to said movable door for translating said movable door.

13. The mechanism of claim 12 wherein said door actuator means allow said movable door to be translated to any position between and including fully closed and fully open.

14. The mechanism of claim 12 wherein said door actuator means comprises a pair of fluid cylinders, each fluid cylinder being connected to a respective side of said movable door and said door frame.

15. The mechanism of claim 14 wherein said door actuator means includes a limit switch actuator affixed to said movable door, and stationary upper and lower limit switches affixed to said door frame and in communication with said fluid cylinders.

16. The mechanism of claim 9 including a first seal affixed to and surrounding the opening of the enclosure, said first seal being compressed between said enclosure opening and the surfaces of said movable and stationary doors when said movable door is in the closed position, and a second seal affixed to the lower edge of the movable door, said second seal being compressed between said movable door and said stationary door when the movable door is in the closed position.

* * * * *